US006743305B2

(12) United States Patent
Short

(10) Patent No.: US 6,743,305 B2
(45) Date of Patent: Jun. 1, 2004

(54) HIGH-STRENGTH HIGH-TOUGHNESS PRECIPITATION-HARDENED STEEL

(75) Inventor: John William Short, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 93 days.

(21) Appl. No.: 10/038,223

(22) Filed: Oct. 23, 2001

(65) Prior Publication Data

US 2003/0102057 A1 Jun. 5, 2003

(51) Int. Cl.[7] ..... C22C 38/42; C22C 38/48
(52) U.S. Cl. ..... 148/326
(58) Field of Search ..... 148/325, 326, 148/505, 607; 420/91

(56) References Cited

U.S. PATENT DOCUMENTS

| | | | | |
|---|---|---|---|---|
| 3,574,601 A | | 4/1971 | Myers et al. | 420/38 |
| 4,227,923 A | * | 10/1980 | Watanabe et al. | 420/38 |
| 4,857,120 A | * | 8/1989 | Watanabe et al. | 148/325 |
| 5,411,513 A | * | 5/1995 | Ireland et al. | 606/171 |
| 5,496,421 A | * | 3/1996 | Hashizume et al. | 148/326 |
| 5,512,237 A | * | 4/1996 | Stigenberg | 420/49 |
| 5,599,408 A | * | 2/1997 | Fujita et al. | 148/607 |
| 5,824,285 A | * | 10/1998 | Koksbang | 423/599 |

FOREIGN PATENT DOCUMENTS

| | | |
|---|---|---|
| EP | 0384317 | 2/1990 |
| EP | 0649915 | 10/1994 |

OTHER PUBLICATIONS

Lewis P. Myers, Kermit J. Goda Jr. "A New High–Strength Stainless Suitable for Cryogenic Use"; Cryog. Technol., (1965) vol. 1 No. 6, pp. 261–264.*

Carpenter Technology Corporation, *Custom 450 Stainless, Alloy Data,* Aug. 1994.

Henthorne, M., et al, Custom 450—*A New High Strength Stainless Steel,* pp. 53/1–53/23.

Carpenter Technology Corporation, *Carpenter Custom 450, Multiple–Strength Stainless Steel,* 1971, pp. 1–21.

Kosa, T., et al, *Effect of Heat Treatment and Microstructure on the Mechanical and Corrosion Properties of a Precipitation Hardenable Stainless Steel,* pp. 367–381.

Bridge, J. Edwin, et al, *Effect of Reverted Austenite on the Mechanical Properties and Toughness of a High Strength Maraging Stainless Steel,* Metallography as a Quality Control Tool, 1980, pp. 279–295.

Irvine, K. J., et al, *The Physical Metallurgy of* 12% *Chromium Steels,* Journal of The Iron and Steel Institute, Aug. 1960, pp. 386–405.

Irvine, K. J., et al, *High–Strength* 12% *Chromium Steels,* MG Conf., 12/64, pp. 34–48.

Sinha, K. K., et al, *P–H Stainless Steels—Indigenous Efforts for Self Reliance,* Tool and Alloy Steels—Annual, 12/90, pp. 443–454.

Misra, R. D. K., et al, *Role of Molybdenum on Impact Toughness in Precipitation Hardened Stainless Steel,* Scripta Metallurgica, vol. 20, 1986, pp. 1339–1342.

(List continued on next page.)

*Primary Examiner*—Deborah Yee
(74) *Attorney, Agent, or Firm*—Ernest Cusick; Gary M. Hartman; Domenica N. S. Hartman

(57) ABSTRACT

A stainless steel alloy that exhibits both high strength and toughness as a result of having particular ranges for chemistry, tempering temperatures and grain size. The alloy is a precipitation-hardened martensitic stainless steel with an ultimate tensile strength of at least 1200 MPa, a Charpy impact toughness of greater than 55 J, and a grain size of ASTM 5 or finer. The alloy consists essentially of, by weight, 14.0 to 16.0 percent chromium, 6.0 to 7.0 percent nickel, 1.25 to 1.75 percent copper, 0.5 to 1.0 percent molybdenum, 0.03 to 0.5 percent carbon, niobium in an amount by weight of ten to twenty times greater than carbon, the balance iron, minor alloying constituents and impurities.

11 Claims, 2 Drawing Sheets

OTHER PUBLICATIONS

Misra, R. D. K., et al, *On Variation of Impact Toughness in 17–4 Precipitation Hardened Stainless Steel,* Scripta Metallurgica, vol. 21, 1987, pp. 1067–1070.

Nageswararao, M., et al, *Factors Influencing the Toughness of 17/4 Stainless Steel,* Superalloys Project, 1985, pp. 330–337.

Loria, Edward, et al, *Influence of Delta Ferrite–Carbide Segregates on the Properties of* 12% *Chromium Steel,* Transactions Quarterly, V I. 54, No. 1, Mar., 1961, pp. 31–49.

*Applications to Materials Testing,* Brittle Fracture and Impact Testing, pp. 473–482.

* cited by examiner

HIGH-STRENGTH HIGH-TOUGHNESS PRECIPITATION-HARDENED STEEL

CROSS REFERENCE TO RELATED APPLICATIONS

Not applicable.

STATEMENT REGARDING FEDERALLY SPONSORED RESEARCH

Not applicable.

BACKGROUND OF THE INVENTION (1) Field of the Invention

The present invention generally relates to high strength stainless steels suitable for forming rotating turbine components. More particularly, this invention relates to a precipitation-hardened stainless steel containing both carbon and niobium at a specified ratio, a low nitrogen content, and processed to have a grain size and at certain tempering temperatures to provide an excellent combination of strength and toughness.

(2) Description of the Related Art

Specific strength and toughness requirements must be met for rotating steam turbine components in order to achieve safe and efficient operation. For more demanding turbine environments, conventional stainless steels in current use do not achieve a desired combination of mechanical properties at a cost that permits their widespread use. For example, conventional stainless steels having ultimate tensile strengths (UTS) of 175 ksi (about 1200 MPa) or more generally do not exhibit a Charpy impact toughness of more than 40 ft·lbs (about 55 J).

U.S. Pat. No. 3,574,601 discloses the stainless steel commercially known as Carpenter Custom 450, and focuses on corrosion resistance in the overaged condition. A maximum UTS of 152.5 ksi (about 1050 MPa) is reported for the alloy in the patent. The literature regarding this alloy reports an aging temperature range of 800° F. to 1000° F. (about 427° C. to 538° C.), with aging at 900° F. (about 480° C.) producing maximum strength but lowest toughness. The literature also reports a UTS of greater than 175 ksi (1200 MPa) after aging at 900° F. to 950° F. (about 480° C. to 510° C.), but an Izod impact toughness of less than 70 J. The Custom 450 alloy contains chromium, nickel, molybdenum and copper, as well as other potential alloying constituents such as carbon and niobium (columbium), to yield essentially a martensitic microstructure. To stabilize carbon as an austenite former, niobium may be added at a weight ratio of up to ten relative to carbon if carbon is present in an amount above 0.03 weight percent. U.S. Pat. No. 3,574,601 teaches that heat treatment is not critical for the Custom 450 alloy, and any effect that grain size might have on the properties of the alloy is not discussed.

The literature has reported on the significant role that nitrogen and carbon have on the impact toughness of martensitic stainless steels containing 12 weight percent chromium. The negative effects of the delta (δ) ferrite phase on mechanical properties are also well documented for 12% Cr martensitic stainless steels. Finally, grain size is known to effect impact strength, based in part on the increase in cleavage fracture stress corresponding to decreasing grain size. Notwithstanding the above, a martensitic stainless steel that exhibits the combination of high strength and toughness is not available. Instead, efforts have largely been directed to martensitic stainless steels that emphasize increased corrosion resistance over strength for use in highly corrosive environments, such as the alloys disclosed in EP0649915A1 and EP0384317A1 and intended for the transportation of oil or natural gas.

In view of the above, it would be advantageous if a stainless steel existed that offered a unique combination of high strength and high toughness suitable for rotating steam turbine components.

BRIEF SUMMARY OF THE INVENTION

The present invention provides an improved stainless steel alloy that exhibits both high strength and toughness as a result of having particular ranges for chemistry, tempering temperatures and grain size. The alloy of this invention is a precipitation-hardened stainless steel, in which the hardening phase includes copper-rich precipitates in a martensitic microstructure. Required mechanical properties of the alloy include an ultimate tensile strength (UTS) of at least 175 ksi (about 1200 MPa), and a Charpy impact toughness of greater than 40 ft·lb (about 55 J). According to the invention, these properties are obtained with a precipitation-hardened stainless steel alloy consisting essentially of, by weight, 14.0 to 16.0 percent chromium, 6.0 to 7.0 percent nickel, 1.25 to 1.75 percent copper, 0.5 to 1.0 percent molybdenum, 0.03 to 0.5 percent carbon, niobium in an amount by weight of ten to twenty times greater than carbon, the balance iron, minor alloying constituents and impurities. Maximum levels for the minor alloying constituents and impurities are, by weight, 1.0 percent manganese, 1.0 percent silicon, 0.1 percent vanadium, 0.1 percent tin, 0.030 percent nitrogen, 0.020 percent phosphorus, 0.025 percent aluminum, 0.008 percent sulfur, 0.005 percent silver, and 0.005 percent lead.

The above alloy differs from the Carpenter Custom 450 stainless steel in several important aspects. First, the focus of the Custom 450 alloy is corrosion resistance, and not a combination of high strength and toughness. To achieve improved toughness as compared to Custom 450, the alloy of this invention relies on a particular combination of chemistry, microstructure and tempering temperature. In terms of chemistry, the alloy employs a very narrow range for carbon content, a range of Nb/C ratios higher than Custom 450 (U.S. Pat. No. 3,574,601, and a very limited nitrogen content to promote impact toughness. Also preferred to meet the required impact toughness is a grain size of ASTM 5 (average grain diameter of 62 micrometers) or finer, and more preferably a grain size of ASTM 7 (average grain diameter of 32 micrometers) or finer. Also important to the alloy is a delta ferrite content of less than 0.5 weight percent, in view of the negative effects of the delta ferrite phase on mechanical properties. Finally, the processing of the alloy includes an austenizing heat treatment at a temperature of about 980° C. to about 1100° C., followed by tempering (aging) at a temperature of about 900° F. to 975° F. (about 480° C. to about 525° C.). The tempering heat treatment is particularly important to obtaining the strength and impact toughness properties required by this invention. Aside from the assumption that the alloy does not contain any prior melt or process related defects, it is believed that the desired mechanical properties of the precipitation-hardened stainless steels of this invention do not rely on prior melting practices, thermal mechanical processing, and heat treatments as long as the chemistry, grain size and tempering range (480° C. to about 525° C.) conform to that noted above.

In view of the above, those skilled in the art will appreciate that the precipitation-hardened stainless steel alloy of this invention is characterized by a combination of both high tensile strength and impact toughness at levels that exceed the capability of commercially available stainless steel alloys with similar chemistries. The alloy achieves these advantages without special processing techniques, other than the tempering temperature range noted above. As a result, the alloy of this invention is well suited for such demanding applications as rotating components for steam turbines.

Other objects and advantages of this invention will be better appreciated from the following detailed description.

DETAILED DESCRIPTION OF THE INVENTION

Figure 1:
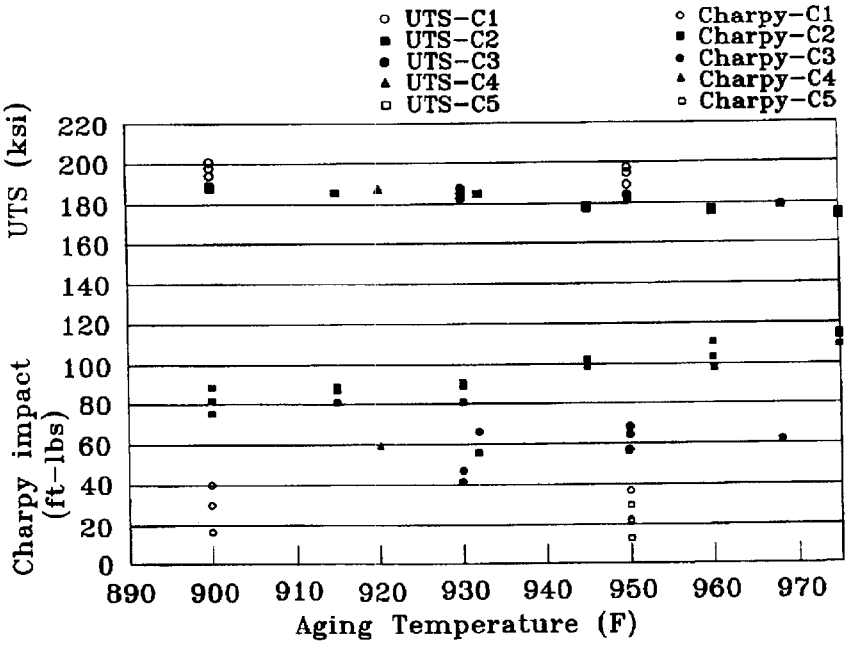
FIG. 1 is a graph plotting tensile strength and Charpy impact data versus aging temperature for precipitation-hardened stainless steels of this invention as well as stainless steels whose chemistries differ from the present invention.

The present invention is an improved martensitic stainless steel alloy whose chemistry and processing achieve an excellent combination of strength and toughness. The steel alloy of this invention is characterized by a hardening phase of copper-rich precipitates, which in combination with certain chemistry and processing requirements yields the desired strength and toughness properties for the alloy. The alloy of this invention preferably exhibits an ultimate tensile strength of at least 175 ksi (about 1200 MPa), preferably in excess of 185 ksi (about 1275 MPa), and a Charpy impact toughness of greater than 40 ft·lb (about 55 J), preferably in excess of 60 ft·lb (about 80 J).

Suitable and preferred compositions for the stainless steel alloy of this invention are summarized in Table 1 below.

TABLE 1

| Element | Suitable (wt. %) | Preferred (wt. %) |
|---|---|---|
| Cr | 14.0–16.0 | 14.5 |
| Ni | 6.0–7.0 | 6.5 |
| Cu | 1.25–1.75 | 1.5 |
| Mo | 0.5–1.0 | 0.7 |
| C | 0.03–0.5 | 0.03–0.04 |
| Nb | 10–20 × C | 10–15 × C |
| Mn | up to 1.0 | 0.3–0.8 |
| Si | up to 1.0 | 0.2–0.5 |
| V | up to 0.1 | 0.05 |
| Sn | up to 0.1 | less than 0.01 |
| N | up to 0.030 | less than 0.020 |
| P | up to 0.020 | less than 0.015 |
| Al | up to 0.025 | less than 0.020 |
| S | up to 0.008 | less than 0.0002 |
| Ag | up to 0.005 | less than 0.0001 |
| Pb | up to 0.005 | less than 0.0001 |
| Fe | balance | balance |

In view of the above, chromium, nickel, copper, molybdenum, carbon and niobium are required constituents of the stainless steel alloy of this invention, and are present in amounts that ensure an essentially martensitic microstructure. As in the Custom 450 alloy (U.S. Pat. No. 3,574,601, copper is critical for forming the copper-rich precipitates required to strengthen the alloy. Notably, the invention employs a very narrow range for carbon content, a range of Nb/C ratios higher than Custom 450, and a very limited nitrogen content to promote impact toughness. More particularly, nitrogen contents above 0.03 weight percent were determined to have an unacceptable adverse effect on toughness.

Carbon is an intentional constituent of the alloy of this invention as a key element in the formation of complex and simple carbides that act as an additional strengthening mechanism with the copper-rich precipitates. However, in comparison to other steels such as Type 422 (carbon content of about 0.10 to 0.20 weight percent), carbon is maintained at impurity-type levels. The limited amount of carbon present in the alloy is stabilized with niobium so as not to form austenite. The relatively high Nb/C ratio is contrary to U.S. Pat. No. 3,574,601 (Custom 450), but in accordance with this invention is necessary to achieve the desired level of impact toughness. In the past, niobium levels were kept very low on the basis of a theoretical ratio of about 8:1 required to completely tie up all niobium and carbon. What role any excess niobium might play in the strength or toughness of a precipitation-hardened stainless steel was not established. However, with this invention, it is believed that higher niobium contents (relative to carbon) impact carbide formation of the other major carbides present in the alloy (e.g., chromium carbides, molybdenum carbides, etc.), and may also influence the precipitation reaction during tempering. At the minimum Nb/C ratio of 10, maximum toughness is achieved when using a minimum amount of strengthening agents to obtain a desirable strength level. At the preferred maximum Nb/C ratio of 15, acceptable toughness is still achieved for a maximum amount of strengthening agent. At Nb/C ratios of 15 to the maximum of 20, toughness is lower but still acceptable for many applications.

While other carbon stabilizers are known, including titanium, zirconium, vanadium and tantalum, they have been found to have a detrimental effect on the toughness of the alloy due to embrittling carbides and/or nitrides that form. For example, intentional additions of titanium to the alloy resulted in the formation of titanium nitride (TiN), which was associated with a severe reduction in toughness when present in any appreciable amount. Vanadium levels above that indicated in Table 1 were determined to have the same effect as a result of the formation of vanadium carbide (VC).

As known in the art, chromium provides the stainless properties for the alloy, and for this reason a minimum chromium content of 14 weight percent is required for the alloy. However, as discussed in U.S. Pat. No. 3,574,601, chromium is a ferrite former, and is therefore limited to an amount of about 16 weight percent in the alloy. The chromium content of the alloy must also be taken into consideration with the nickel content to ensure that the alloy is essentially martensitic. As discussed in U.S. Pat. No. 3,574,601, nickel promotes corrosion resistance and works to balance the martensitic microstructure, but also is an austenite former. The narrow range of 6.0 to 7.0 weight percent nickel serves to obtain the desirable effects of nickel and avoid austenite. Molybdenum also promotes the corrosion resistance of the alloy, while also being effective to avoid hydrogen embrittlement. The relatively narrow range for molybdenum specified for this alloy has the effect of reducing the amount of delta ferrite, which is required to be kept to particularly low levels in the alloy as will be discussed below. It may be possible to substitute tungsten for all or part of the molybdenum content of the alloy.

Manganese and silicon are not required in the alloy, and vanadium, nitrogen, aluminum, phosphorus and sulfur are all considered to be impurities. However, as shown in Table 1, both manganese and silicon are preferably present in the alloy, and at levels sufficient to contribute to the balance of ferrite and austenite. As known in the art, silicon also provides segregation control when melting steels.

Typical and preferred physical and mechanical properties of the alloy are summarized in Table 2 below.

TABLE 2

| Property | Typical | Preferred |
|---|---|---|
| Grain size | ASTM 5 or finer | ASTM 7 or finer |
| Delta ferrite | <0.5 wt. % | <0.5 wt. % |
| UTS | at least 1200 MPa | at least 1275 MPa |
| 0.2% YS | at least 1100 MPa | at least 1100 MPa |
| Charpy impact | greater than 55 J | 80–110 J |

According to the invention, the levels for impact toughness specified in Table 2 cannot be achieved if the Nb/C ratio and nitrogen content specified in Table 1 and the grain size specified in Table 2 are not met. The effect of grain size on Charpy impact strength is attributed in part to the increase in cleavage fracture stress with decreasing grain size, though finer grain size may also improve toughness as a result of having an effect on the upper shelf energy. Also important to the alloy is a delta ferrite content of less than 0.5 weight percent, in view of the negative effect that this phase has on mechanical properties.

A final important aspect of the invention is the requirement for a tempering heat treatment performed at a temperature of about 900° F. to about 975° F. (about 480° C. to about 525° C.) for a duration of at least four hours. For lower Nb/C ratios, such as below 15, a tempering temperature of about 900° F. to about 930° F. (about 480° C. to about 500° C.) is preferred. Otherwise, the stainless steel alloy of this invention can be processed by substantially conventional methods. For example, the alloy may be produced by argon oxygen decarburization (AOD) with ladle refinement, followed by electro slag remelting (ESR) of the ingots. Vacuum induction melting (VIM) followed by vacuum arc remelting (VAR) may also be used. A suitable forming operation is then employed to produce forgings, plates, sheet and bar stock. The alloy is then austenized by heating to about 1800° F. to about 2012° F. (abut 982° C. to about 1100° C.) for about one to two hours, followed by the tempering heat treatment discussed above.

In an investigation leading to this invention, seven alloys were prepared having the compositions (in weight percent) and average ASTM grain size ("GS") set forth in Table 3 below.

TABLE 3

| | C1 | C2 | C3 | C4 | C5 | C6 | C7 |
|---|---|---|---|---|---|---|---|
| Cr | 14.82 | 14.43 | 14.66 | 14.62 | 14.27 | 14.60 | 14.42 |
| Ni | 6.57 | 6.38 | 6.49 | 6.48 | 6.21 | 6.42 | 6.39 |
| Cu | 1.50 | 1.41 | — | 1.46 | 1.42 | 1.37 | 1.43 |
| Mo | 0.75 | 0.63 | 0.75 | 0.89 | 0.78 | 0.80 | 0.65 |
| C | 0.025 | 0.033 | 0.031 | 0.035 | 0.023 | 0.023 | 0.036 |
| Nb | 0.53 | 0.33 | 0.50 | 0.42 | 0.64 | 0.52 | 0.38 |
| Nb/C | 21.2 | 10.0 | 16.1 | 12.0 | 27.8 | 22.6 | 10.6 |
| Mn | 0.41 | 0.67 | 0.55 | 0.48 | 0.72 | 0.32 | 0.68 |
| Si | 0.42 | 0.42 | 0.49 | 0.40 | 0.28 | 0.55 | 0.44 |
| V | — | 0.05 | — | 0.08 | 0.02 | 0.04 | 0.03 |
| N | — | 0.010 | 0.030 | 0.022 | 0.059 | 0.17 | 0.13 |
| P | 0.021 | 0.016 | 0.017 | 0.019 | 0.015 | 0.020 | 0.012 |
| S | 0.002 | 0.0001 | 0.002 | 0.001 | 0.002 | 0.002 | 0.002 |
| Fe | bal. | bal. | bal. | bal. | bal. | bal. | bal. |
| GS | n/a | 6 | 7 | 7.5 | 3.5 | 6 | 8 |

Alloy C1 was the Custom 450 alloy commercially available from Carpenter. Notably, while alloy C1 bad a composition within the limits published for the Custom 450 alloy (e.g., Nb/C ratio: 8×C minimum), its Nb/C ratio exceeded that set for the Custom 450 alloy in U.S. Pat. No. 3,574,601 (Nb/C ratio: 10×C maximum). The alloy also had a low carbon content, a high Nb/C ratio, and a high phosphorus content relative to the limits for the alloy of this invention set forth in Table I. Alloy C2 had a fine grain size, the lowest Nb/C ratio and lowest nitrogen content. At the other extreme, alloy C5 had the largest grain size, the highest Nb/C ratio (including a carbon content below that allowed in Table 1) and the highest nitrogen content, each of which was outside the limits allowed in Tables 1 and 2. Similar to alloy C2, alloys C3 and C4 also had fine grain sizes, but Nb/C ratios and nitrogen contents intermediate that of alloys C2 and C5. Alloys C6 and C7 also had fine grain sizes and low nitrogen contents, but Alloy C7 had a Nb/C ratio close to that of C2 while Alloy C6 had a Nb/C ratio (resulting from a carbon content below that allowed in Table 1) that exceeded the upper limit in Table 1. In summary, all of the alloys had carbon contents and Nb/C ratios within the published limits for the commercial Custom 450 alloy, though alloys C1 (Custom 450), C5 and C6 had Nb/C ratios, alloy C1 had a phosphorous content, and alloy C5 had a nitrogen content that were outside the ranges specified for the alloy of this invention.

Standard specimens for tensile and Charpy impact tests were prepared from the above alloys. Alloys C1 through C5 were produced as bar stock, while Alloys C6 and C7 were produced as forgings. All of the alloys underwent identical thermal processing, including austenizing at about 1900° F. (about 1040° C.) for about one to two hours. The specimens were then aged by tempering for about one to two hours at a temperature in the range of from about 900° F. (about 482° C.) to about 1040° F. (about 560° C.).

The results of tensile and Charpy impact tests performed on the bar stock specimens (alloys C1 through C5) tempered at about 900° F. (about 482° C.) to about 990° F. (about 532° C.) are summarized in FIG. 1, in which "UTS" followed by the alloy designation (C1 through C5 from Table 3) represents results of tensile test specimens, and "Charpy" followed by the alloy designation (C1 through C5) represents results obtained with the Charpy impact test specimens. The results evidence that the best impact toughness exhibited by the C1 and C5 alloys was not higher than 40 ft·lbs (about 55 J). In comparison, the impact toughness of the C2, C3 and C4 alloys of this invention ranged from above 40 ft·lbs (above 55 J) to nearly 120 ft·lbs (about 160 MPa). This stark difference in impact resistance was observed though the C1 and C5 alloys exhibited ultimate tensile strengths comparable to or slightly better than the C2, C3 and C4 alloys of this invention. The best impact resistance was exhibited by the C2 alloy, which differed from the C3 and C4 alloys primarily on the basis of a lower nitrogen content and lower Nb/C ratio. In comparison to the C1 and C5 alloys, the impact resistance of the C2, C3 and C4 alloys was a combination of lower nitrogen content, lower Nb/C ratio, and finer grain size.

Figure 2:
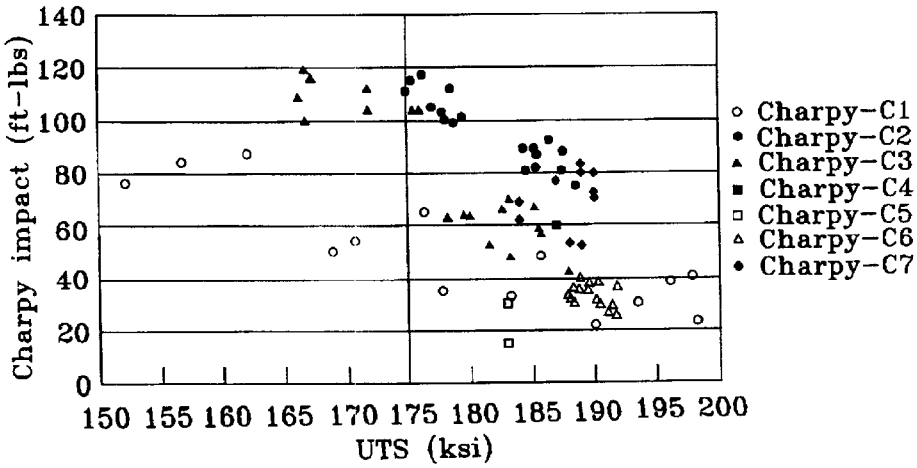
FIG. 2 is a graph plotting Charpy impact data versus tensile strength for precipitation-hardened stainless steels of this invention and stainless steels whose chemistries differ from the present invention.

FIG. 2 plots Charpy impact versus tensile strength for all alloys specimens (alloys C1 through C7), and evidences that alloys C1, C5 and C6 —which are outside the scope of this invention, were largely unable to meet the minimum requirements for strength (175 ksi (1200 MPa) minimum) and toughness (greater than 40 ft·lbs (55 J) minimum) established for this invention. The explanation for the six low-strength data points for the C3 alloy was concluded to be specimens tempered in the range of about 1004° F. (about 540° C.) to about 1040° F. (about 560° C.), and therefore outside of the 900–990° F. range of FIG. 1.

Figure 3:
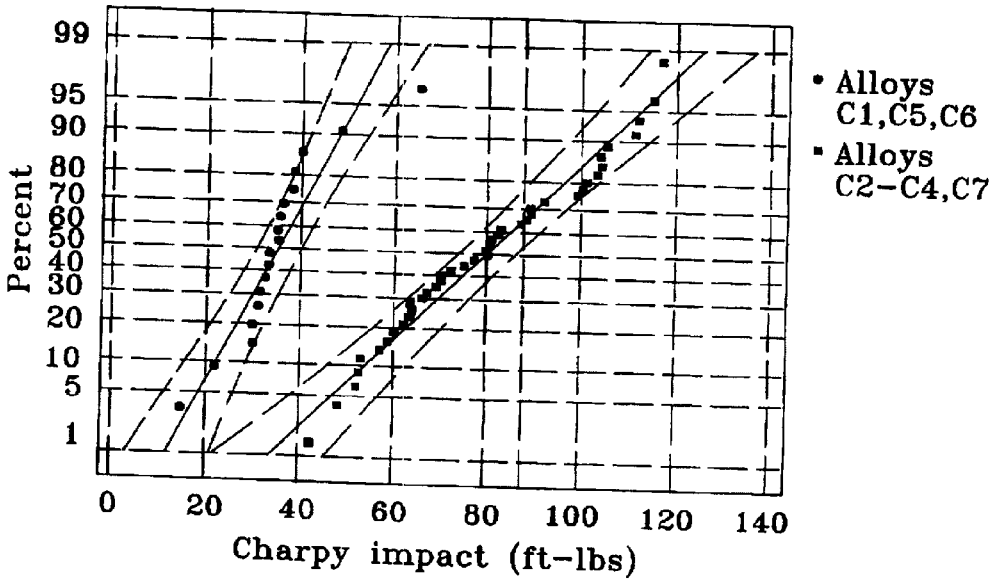
FIGS. 3 and 4 are graphs that statistically compare the Charpy impact data of FIG. 2.
Figure 4:
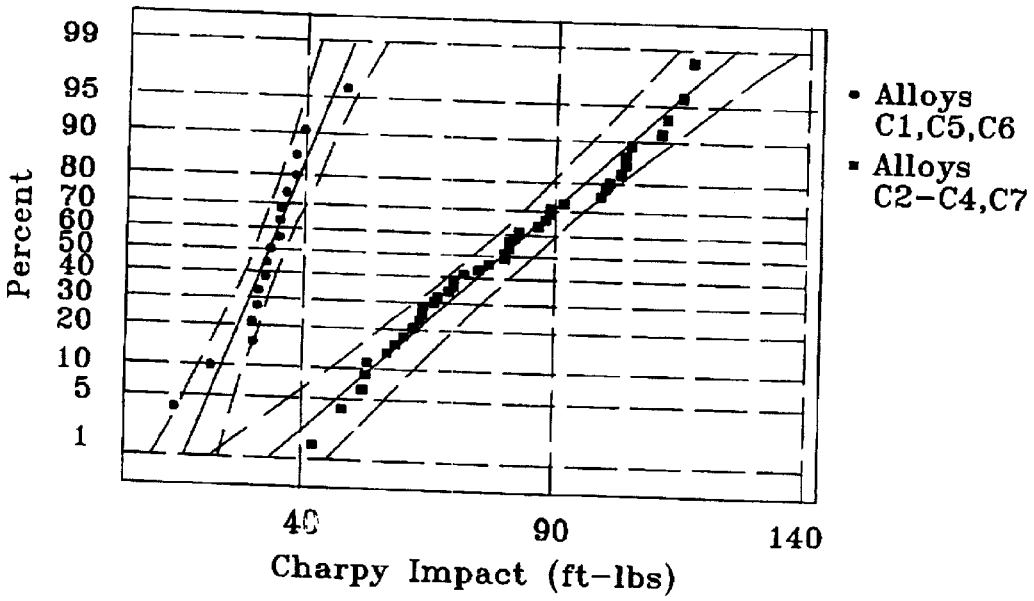

Finally, FIG. 3 is a normal probability plot (95% confidence interval) of the Charpy impact data for those alloys in FIG. 2 with strengths in the range of 175 to 190 ksi (abut 1200 to about 1310 MPa). FIG. 3 evidences the significant difference between the toughness of the alloys of the invention (C2, C3, C4 and C7) and those outside the invention (C1, C5 and C6). The curves for these two sets of alloys do not overlap, which evidences that the two populations are statistically independent. In addition, it can be seen that the varying strengths of the different alloys did not impact the distributions, establishing that chemistry had a clear effect on toughness. The 65 ft·lb data point for the C1 alloy in FIG. 2 is shown with FIG. 3 to be a statistical outlier that, when removed from the analysis for strict rigor, did not change the statistical significance of the data, as shown in FIG. 4. According to this analysis, the 65 ft·lb data point for the C1 alloy can be disregarded. As those skilled in the art will recognize, the data evidence that it is only with those alloys processed in accordance with this invention that toughness levels in excess of 40 ft·lb were consistently obtained for purposes of achieving a manufacturing capability from a production materials specification.

From the above, it is apparent that the stainless steel alloy of this invention is characterized by an excellent combination of toughness and strength, in which the toughness exhibited far exceeds the toughness of alloys with similar compositions but that differ in terms of carbon content, nitrogen content, Nb/C ratio and grain size. As such, the results represented in FIG. 2 evidence the criticality of the carbon content, nitrogen content, and Nb/C ratio of the precipitation-hardened stainless steel alloy of this invention.

While the invention has been described in terms of a preferred embodiment, it is apparent that other forms could be adopted by one skilled in the art. Therefore, the scope of the invention is to be limited only by the following claims.

What is claimed is:

1. A precipitation-hardened stainless steel alloy consisting of, by weight:

14.0 to 16.0 percent chromium;

6.0 to 7.0 percent nickel;

1.25 to 1.75 percent copper;

0.5 to 1.0 percent molybdenum;

0.03 to 0.5 percent carbon;

niobium in an amount by weight of ten to twenty times greater than carbon;

not greater than 1.0 percent manganese;

not greater than 1.0 percent silicon;

not greater than 0.1 percent vanadium;

not greater than 0.1 percent tin;

not greater than 0.030 percent nitrogen;

not greater than 0.020 percent phosphorus;

not greater than 0.025 percent aluminum;

not greater than 0.008 percent sulfur;

not greater than 0.005 percent silver;

not greater than 0.005 percent lead; and the balance being essentially iron;

wherein the alloy has been tempered at a temperature of about 480° C. to about 525° C. to have an ultimate tensile strength of at least 1200 MPa and a Charpy impact toughness of at least 70 J.

2. A precipitation-hardened stainless steel alloy according to claim 1, wherein the steel alloy has a Charpy impact toughness of at least 80 J.

3. A precipitation-hardened stainless steel alloy according to claim 1, wherein the alloy contains niobium in an amount by weight of 10.0 to about 15 times greater than carbon.

4. A precipitation-hardened stainless steel alloy according to claim 1, wherein the carbon content of the alloy is 0.03 to about 0.04 weight percent.

5. A precipitation-hardened stainless steel alloy according to claim 1, wherein the nitrogen content of the alloy is less than 0.020 weight percent.

6. A precipitation-hardened stainless steel alloy according to claim 1, wherein the grain size of the alloy is ASTM 5 or finer.

7. A precipitation-hardened stainless steel alloy according to claim 1, wherein the alloy is in the form of a steam turbine component.

8. A steam turbine component formed of a precipitation-hardened stainless steel alloy consisting of, by weight:

about 14.5 percent chromium;

about 6.5 percent nickel;

about 1.5 percent copper, about 0.7 percent molybdenum;

0.03 to 0.4 percent carbon;

niobium in an amount by weight of 10.0 to about 15 times greater than carbon;

about 0.3 to about 0.8 percent manganese;

about 0.2 to about 0.5 percent silicon;

not greater than 0.05 percent vanadium;

not greater than 0.01 percent tin;

not greater than 0.030 percent nitrogen;

not greater than 0.015 percent phosphorus;

not greater than 0.020 percent aluminum;

not greater than 0.0002 percent sulfur;

not greater than 0.0001 percent silver;

not greater than 0.0001 percent lead;

the balance being essentially iron;

wherein the alloy has a grain size of ASTM 7 or finer, a delta ferrite content of less than 0.5 weight percent, an ultimate tensile strength of at least 1275 MPa, a Charpy impact toughness of at least 80 J, and has been tempered at a temperature of about 480° C. to about 500° C.

9. A steam turbine component according to claim 8, wherein the alloy has a Charpy impact toughness of 80 to about 110 J.

10. A precipitation-hardened stainless steel alloy according to claim 1, wherein the alloy has a delta ferrite content of less than 0.5 weight percent.

11. A precipitation-hardened stainless steel alloy according to claim 1, wherein the alloy has an ultimate tensile strength of at least 1275 MPa.

* * * * *